US005769395A

United States Patent [19]

Patti

[11] Patent Number: 5,769,395

[45] Date of Patent: Jun. 23, 1998

[54] AUTOMOBILE DRIVE SHAFT REMOVAL DEVICE

[76] Inventor: Louis P. Patti, 30 Tower Rd., Arlington, Mass. 02174

[21] Appl. No.: 723,569

[22] Filed: Sep. 30, 1996

[51] Int. Cl.[6] ..... B66F 3/00

[52] U.S. Cl. ..... 254/129; 254/131; 29/267

[58] Field of Search ..... 254/120, 129, 254/130, 131; 29/245, 267

[56] References Cited

U.S. PATENT DOCUMENTS

| | | | |
|---|---|---|---|
| 1,372,389 | 3/1921 | Bailey et al. | 29/267 |
| 1,485,405 | 3/1924 | Merriman | 29/220 |
| 1,516,589 | 11/1924 | Dewey | 254/131 |
| 1,737,084 | 11/1929 | Hilstad | 29/245 |
| 2,191,720 | 2/1940 | Meinhardt | 29/245 |
| 2,311,063 | 2/1943 | Martin | 254/131 |
| 2,500,221 | 3/1950 | Wagner | 29/245 |
| 2,718,375 | 9/1955 | Purdy | 254/131 |
| 2,878,699 | 3/1959 | Stricklett | 29/245 |
| 3,537,685 | 11/1970 | Gregory | 254/131 |
| 3,840,211 | 10/1974 | Castoe | 254/131 |
| 4,303,224 | 12/1981 | Nelson | 254/131 |
| 5,102,100 | 4/1992 | Troncoso, Jr. | 254/129 |
| 5,360,199 | 11/1994 | Speier | 254/131 |

*Primary Examiner*—Robert C. Watson

*Attorney, Agent, or Firm*—Patent & Trademark Services; Thomas Zack; Joseph H. McGlynn

[57] ABSTRACT

A tool for moving a disconnected vechicle's component, such as its front suspension, out of the way to permit working on the vehicle's front wheel drive shaft. A straight handle has a S-shaped hook suspended along its length. This hook is mounted to the component to be moved. A pivotally mounted T-shaped front end handle piece fits under a sturdy stationary vehicle component. Adjustment holes in the vertical leg of the front end piece are engaged by a pin which extends through a hole in the handle's front end slot. A rubber pad prevents slipping between the stationary vehicle part and the tool's front end piece while spaced handle stops prevent movement between the suspended hook and the handle. The application of sufficient downward force to the handle's end opposite its T-shaped piece will move the desired disconnected hook suspended vehicle component.

5 Claims, 1 Drawing Sheet

AUTOMOBILE DRIVE SHAFT REMOVAL DEVICE

BACKGROUND OF THE INVENTION

Mechanics and persons who work on automobiles are constantly attempting to develop apparatuses and devices which will speed up the work, make the work safer to perform or easier to accomplish. Removing front wheel drive shafts is a problem area has proven particularly vexing since front suspension components (e.g., lower control arm, lower ball joint) must be disconnected and moved out of the way. The present invention permits the easy removal of the front suspension components by one person thereby allowing the necessary work to performed on the front wheel drive shaft.

DESCRIPTION OF THE PRIOR ART

Many types of handled tools have been developed which assist persons working on hard to get at members, especially in the automobile art. For example, in U.S. Pat. No. 3,537,685 to Gregory a tool having an elongated handle and a pivotally joined A-Frame Frame engaging end is used to adjust the camber and castor on vehicles. In the Castoe invention (U.S. Pat. No. 3,840,211) a long handled tool having a hooked end is used to engage and adjust the inner shaft of the wheel assembly. Still another camber and caster adjustment tool having an elongated handle with a vehicle engaging end, uses a lever-type force action in the U.S. Pat. No. 4,303,224 to Nelson. A long handled tool which employs leverage to remove a window or door grille is disclosed in the U.S. Pat. No. 5,360,199 to Speier. None of the cited or known references, however, are specifically designed in structure and function to move the vehicle components such as front end suspensions out of the way as disclosed herein.

SUMMARY OF THE INVENTION

A tool for moving the front suspension components for a front wheel drive vehicle out of the way to permit easy access to and work on the vehicle's drive shaft. An adjustable T-shape engaging end piece is moved by an elongated handle hooked to the underside of the vehicle. Slippage between the handle and hook is reduced by a series of spaced stops along the handle's length.

It is an object of the present invention to provide an easily assembled and used tool to permit one person to move front suspension component out of the way.

It is a further object to provide such a tool which has an adjustable vehicle engaging piece and has stop to lessen slippage on the actuating device's connection to the vehicle.

DESCRIPTION OF THE PREFERRED EMBODIMENT

Figure 1:
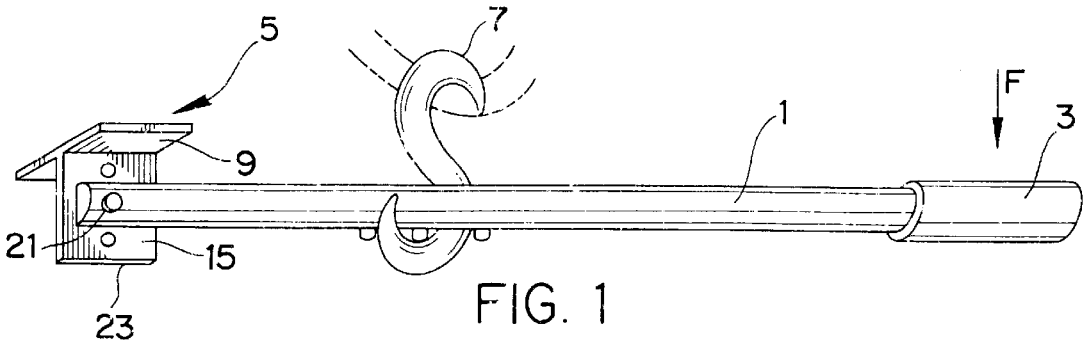
FIG. 1 is a perspective view of the invention's preferred embodiment.

The preferred embodiment is shown in FIG. 1. An elongated straight handle 1 has a hand grip 3 located at one end and a T-shaped front end pieced 5 at its other end. Mounting the handle to a vehicle's under component, such as its lower control arm, is the S-shaped hook 7. The generally horizontally disposed flat rectangular surfaced member 9, forming part of the front end piece 5, fits under and acts as the pivot point in moving the desired vehicle component.

Figure 2:
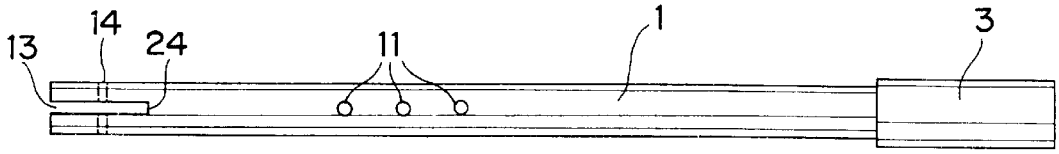
FIG. 2 is a side view of the handle's preferred embodiment.
Figure 3:
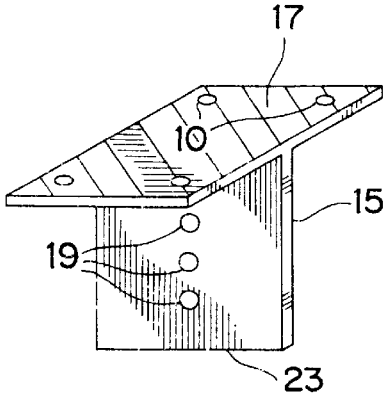
FIG. 3 is a perspective view of the front suspension components engaging end piece.
Figure 4:
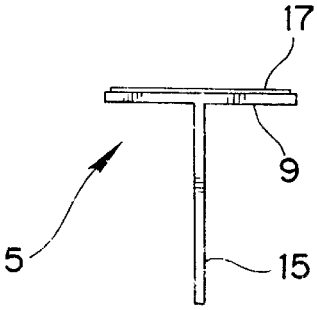
FIG. 4 is a side view of the FIG. 3 end piece.

As shown in FIG. 2 the handle 1 has three spaced screws 11 screwed into it at locations where the hook 7 engages the handle in a mounting operation. At the handle's front end is an opened slot 13 used to receive the vertically disposed rectangular shaped member 15 of the T-shaped piece 5. A hole 14 transverse to the slot's length and extends through the handle's front end about midway along the slot length. FIGS. 3–4 depict front end piece 5 in a perspective view and a side view, respectively. Attached to the vehicle engaging member 9 is a complementarily shaped flat rubber anti-slip pad 17 which increases the frictional contact between the engaged front suspension components and the underlining surface of member 9. Four small holes 18 extends through member 9 slightly inwardly from each corner and act to hold the pad 17 in place.

Three vertically disposed adjustment holes 19 extending through member 15 are used to receive a clevis pin 21 (see FIG. 1) which extends through the handle's hole slot 14 and one of the holes 19 in member 15. A pin clip (not shown) at one end of the pin 21 fixes the front piece 5 to the handle's by a swivel mount thus allowing some play to position the engaging pad 17 under the component before it is moved. The length of slot 13 is slightly greater than vertical member's 15 side width 23 thus allowing some limited pivotal movement of in place piece 5. Greater pivotal movement of piece 5 is prevented by the bearing of vertical member 15 against the slot's handle closed end 24. Adjustment holes 19 allow the pivotal point for pin 21 to be vertically changed to suit the particular use.

In one embodiment the overall length of handle 1 was 45 inches, the member 15 and the slot 13 were 4 inches long, the width 23 was three inches and the upper rectangular member 9 and its attached pad 17 were each 4 by 3 inches with the lesser dimension for member 9 and its pad being in the same direction as width 23. Holes 19 and 14 and clevis pin 21 were each about 7/16 of an inch in diameter while holes 10 were about ¼ inch in diameter. The width of slot 13 is about ¼ inch along its length. Protruding screws 11, used to stop sliding between the hook 7 and handle 1, were about 3/16 an inch in diameter and spaced apart at 7, 10 and 13 inch intervals as measured from the handle's slotted end.

In use the S-hook 7 is first mounted or hung to an underside vehicle component to be moved out of the way. Next, the T-shaped member 5 has its height adjusted by pin 21 and then its pad 17 is placed under and pressed against a study, stationary vehicle member. When sufficient downward force is applied to the handle end 3, the disconnected component (such as the front suspension component, the lower control arm or lower ball joint) will be temporarily moved out of the away to permit work on the front wheel drive automotive drive shaft.

Although the Automobile Drive Shaft Removal Device and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A tool for moving vehicle components comprising:

an elongated handle having a front and a rear end;

an S-shaped hook having two curved opposite ends with one of said ends being mounted on said handle along the handle's length between its front and its rear ends and the other of said curved ends being mounted on the vehicle component to be moved; and a T-shaped front end piece having a vertically disposed member which is pivotally mounted to the handle's front end and a horizontally disposed portion, said horizontally disposed portion of the T-shaped piece being adapted to fit under a stationary vehicle component, whereby the application of sufficient downward force near the handle's rear end will move the vehicle component mounted on the S-hook.

2. The tool as claimed in claim 1, wherein said handle's front end has a slot with a transverse hole and said T-shaped piece has a complementary hole in its vertically disposed member, said T-shaped front end piece being mounted therein by a pin extending through said handle and front end piece holes .

3. The tool as claimed in claim 2, wherein said T-shaped front end piece has a plurality of vertically disposed adjustment holes in its vertically disposed member.

4. The tool as claimed in claim 3, further including a non-slip pad mounted on the T-shaped front end piece which engages the stationary vehicle's component.

5. The tool as claimed in claim 4, also including spaced stop members located along the handle's length where the hook engages the handle.

* * * * *